US005378245A

United States Patent [19]

Balland

[11] Patent Number: 5,378,245

[45] Date of Patent: Jan. 3, 1995

[54] PROCESS OF DYEING USING REACTIVE DYES WITH PRELIMINARY BLEACHING

[75] Inventor: Jean Balland, Chateaurenault, France

[73] Assignee: Manufacture de Produits Chimiques Protex, Paris, France

[21] Appl. No.: 99,141

[22] Filed: Jul. 29, 1993

[30] Foreign Application Priority Data

Jul. 29, 1992 [FR] France ..... 92 09373

[51] Int. Cl.[6] ..... C09B 62/00; D06L 3/02

[52] U.S. Cl. ..... 8/543; 8/108.1; 8/111; 8/585; 8/587; 8/918; 8/931; 8/DIG. 2

[58] Field of Search ..... 8/543, 918, 931, DIG. 2, 8/108.1, 111, 585, 587

[56] References Cited

U.S. PATENT DOCUMENTS

| | | | |
|---|---|---|---|
| 2,739,868 | 3/1956 | Shanley et al. | 8/931 |
| 4,378,967 | 4/1983 | Yotsuya et al. | 8/111 |
| 4,643,736 | 2/1987 | Cholley | 8/138 |
| 4,806,126 | 2/1989 | Sternberger et al. | 8/918 |
| 5,071,439 | 12/1991 | Weible | 8/931 |
| 5,201,915 | 4/1993 | Ricci | 8/107 |

OTHER PUBLICATIONS

Database WPIL, Week 9017, Derwent Publications Ltd, (London GB) AN 90-127450 & JP-A-2 074 666 (Santo Iron Works KK) 14 Mar. 1990.

*Primary Examiner*—Paul Lieberman
*Assistant Examiner*—Caroline L. Dusheck
*Attorney, Agent, or Firm*—Stevens, Davis, Miller & Mosher

[57] ABSTRACT

The invention relates to a process for dyeing cellulose fibres such as cotton fibres, comprising successively the steps of (a) bleaching the cellulose fibres with an alkaline bath containing aqueous hydrogen peroxide; (b) neutralizing the residual hydrogen peroxide with a reducing agent; and (c) dyeing the cellulose fibres with a reactive dye sensitive to said reducing agent, wherein, after stage (b) and at the latest at the beginning stage (c), any residual agent is neutralized by a quantity of an alkali or alkaline-earth metal halogenite sufficient to neutralize it, whereby it is possible not to perform any intermediate rinsing between stages (a) and (c).

12 Claims, No Drawings

PROCESS OF DYEING USING REACTIVE DYES WITH PRELIMINARY BLEACHING

The invention relates to an improvement to the process of dyeing using reactive dyes with preliminary bleaching.

The objective of the present invention is to make it possible to carry out the bleaching and then the dyeing of cellulose fibres with the aid of reactive dyes, without intermediate rinsing.

The dyeing of cellulose fibres, especially of cotton fibres, using the conventional exhaustion process requires a preliminary bleaching of the fibres with the aid of aqueous hydrogen peroxide. The operation is carried out in alkaline medium at a temperature which may be between 80° and 120° C. and for a period which may be of the order of 60 minutes. The application of the chosen reactive dye is then carried out using exhaustion, usually in the presence of an electrolyte (for example NaCl) and of an alkaline agent (for example $Na_2CO_3$) in order to promote the exhaustion of the dye and its fixation onto the fibres, respectively.

The sensitivity of reactive dyes to aqueous hydrogen peroxide means that, in the conventional process, it is indispensable to carry out very careful rinsing between the bleaching and the dyeing in order to remove all traces of the oxidizing agent.

The water, labour and plant costs resulting from the rinsing operations mean that the possibility of reducing, or even completely eliminating the rinses has been investigated.

Various compounds which have reducing properties have been proposed in order to neutralize the residual hydrogen peroxide at the end of the bleaching process and thus to make it possible to avoid all or some of the usual rinses. Thus, the use of thiourea, of a thiosulphate, of a hydrosulphite or of a bisulphite or of some other reducing agent is frequently employed to reduce the residual quantity of hydrogen peroxide at the end of bleaching. Many reactive dyes can thus be applied after the neutralization of the hydrogen peroxide without any appreciable difference appearing, after dyeing, with regard to the intensity or colour produced, in comparison with the conventional process with rinses.

It seems, however, that some reactive dyes, in particular those containing the vinyl sulphone group, as reactive group, in their molecule, exhibit a very high sensitivity to the presence of small quantities of reducing agent. Any trace of one of the abovementioned reducing agents, for example, results, with these dyes, in a very great decrease in the dyeing efficiency. With these dyes it is therefore not possible to avoid very careful rinses between the bleaching and the dyeing.

It would therefore be very useful to have available a process making it possible to overcome the above problem.

The Applicant has noticed that the addition of a halogenite makes it possible to avoid any detrimental effect due to the presence of a rinsing agent.

The invention therefore relates to a process for dyeing cellulose fibres comprising successively a stage (a) of bleaching the cellulose fibres with an alkaline bath containing aqueous hydrogen peroxide, a stage (b) of neutralizing of the residual hydrogen peroxide with a reducing agent in excess, and a stage (c) of dyeing the cellulose fibres with a reactive dye containing a reactive group which is sensitive to reducing agents, characterized in that, after stage (b) and at the latest at the beginning of stage (c), the residual reducing agent is removed by adding a quantity of an alkali or alkaline-earth metal halogenite sufficient to neutralize it, this making it possible not to perform any intermediate rinsing between stages (a) and (c).

The process of the invention is specially useful when the reactive dye is a dye containing a vinyl sulphone group.

The cellulose fibres may be cotton, linen, rayon and the like. The process of the invention is particularly advantageous when the fibre to be treated is cotton.

The action of the halogenite is surprising because other compounds of oxidizing nature, such as persalts or meta-nitrobenzenesulphonate which have been tried for the same purpose have not yielded positive results comparable with those obtained with the halogenites. It has also surprisingly been found that the halogenite had no detrimental effect on the dye despite its oxidizing properties.

As alkali or alkaline-earth metal halogenites there may be mentioned, by way of example, sodium bromite, potassium bromite, calcium bromite, magnesium bromite, sodium chlorite, potassium chlorite, calcium chlorite and magnesium chlorite.

Sodium chlorite is preferred because of its low cost and its availability.

The halogenite treatment can be carried out in the bath which has been used for bleaching after neutralization of the residual hydrogen peroxide, in a bath of reducing agent which has been used for the neutralization of the residual hydrogen peroxide, or in the bath which is to be used for dyeing.

The quantity of halogenite to be used obviously depends on the quantity of residual reducing agent to be neutralized. A person skilled in the art will be easily capable of determining it in each case in question.

Usually, however, the residual quantity of reducing agent to be removed is small and in the case of sodium chlorite it has been found that a quantity of sodium chlorite of between 0.01 and 1 g/liter of bath, preferably between 0.05 and 0.2 g/liter of bath, is usually satisfactory.

The halogenite may be added to a hot or cold bath, the difference being immaterial.

The bleaching and dyeing stages are performed in the usual conditions. Where dyeing is concerned, it is appropriate to take the manufacturer's recommendations into account.

Purely by way of guidance and without any limitation being implied, typical conditions are as follows:

For the bleaching: a treatment of 45–60 minutes in an aqueous bath at 70°–120° C. containing 3–6 $cm^3$/liter of $H_2O_2$ at a concentration of 35% by weight, 2–4 $cm^3$/liter of NaOH at a concentration of 30% by weight, 2–4 $cm^3$/liter of sodium silicate at a concentration of 40° Baumé, and 1–3 $cm^3$/liter of a wetting agent.

For the dyeing: holding for 30–60 rain in an aqueous bath at 30°–80° C. containing 0.01 to 8% by weight of reactive dye and 50–100 g/liter of NaCl and then, after adding 10–30 g/liter of an alkaline agent ($Na_2CO_3$, NaOH, and the like) to the bath, holding for another 30–60 min and, finally, careful rinsing with water.

Examples of reactive dyes capable of being used in the process of the invention are especially the following: C.I. Reactive Red 21, C.I. Reactive Orange 82, C.I. Reactive Violet 5, C.I. Reactive Blue 27, C.I. Reactive Yellow 37, C.I. Reactive Yellow 180, C.I. Reactive Blue 19 and C.I. Reactive Red 180.

The nonlimiting examples below are given for the purpose of illustrating the invention.

EXAMPLE 1

Bleaching of three batches of cotton fibre is carried out by treating them for 1 hour in an aqueous bath, kept at 85° C., containing:

4 $cm^3/l$ of aqueous hydrogen peroxide at a concentration of 35% by volume

3 $cm^3/l$ of aqueous solution of sodium hydroxide at a concentration of 30% by weight 2 $cm^3/l$ of sodium silicate 2 $cm^3/l$ of a wetting agent consisting of an ethoxylated nonylphenol containing 10 ethylene oxide units.

After the bleaching, each of the batches is treated as follows:

1st batch (control): the fibre is rinsed copiously to remove all traces of hydrogen peroxide and the dyeing is then carried out;

2nd batch (comparative): 4 g/l of sodium thiosulphate are added to the bath at the end of bleaching and left to react for 10 minutes at 85° C. At the end of this treatment the total neutralization of the hydrogen peroxide is verified with the aid of an indicator paper. The bath is then emptied and then, without any other rinsing, the dyeing is carried out;

3rd batch (according to the invention): the operating method described for the second bath is repeated except that, after the addition of thiosulphate and waiting for 10 minutes, 0.2 g/l of sodium chlorite are introduced into the bath and left to react for 5 minutes at 85° C. The bath is then emptied and the dyeing operation is then carried out.

Dyeing of the three batches of fibres is carried out by keeping each one for 45 minutes in a bath at 80° C. containing 2% by weight of a reactive dye referred to in the Colour Index under the name C.I. Reactive Red 21 and 5% by weight of NaCl intended to increase the exhaustion, and by then keeping it for another 45 minutes in the said bath heated to 85° C. after adding 2% by weight of sodium carbonate to the latter to promote the fixation of the reactive dye onto the fibre. To finish with, the dyed batches are rinsed, first of all with cold water and then with hot water.

After dyeing, the three dyed batches are inspected in comparison. It is noted that the 2nd batch exhibits a less intense colour than the first and third batches, which are both similar.

EXAMPLE 2

Three batches of cotton fibres are treated as described in Example 1, except that in the case of the 3rd batch, after the treatment for 10 min at 85° C. with sodium thiosulphate, the bath is emptied and dyeing is then carried out in a dye bath additionally containing 0.1 g/l of sodium chlorite.

After dyeing, a comparison of the three dyed batches obtained also shows that the 2nd batch exhibits a colour which is clearly less intense than the first and third batches, both of which are similar.

EXAMPLE 3

Three batches of cotton fibres are bleached as described in Example 1. At the end of the bleaching process each of the three batches is treated as follows:

1st batch (control): the fibre is rinsed copiously and dyeing is then carried out.

2nd batch (comparative): The bleaching bath is emptied and neutralization of the hydrogen peroxide is then carried out. To do this, the fibre is treated for 10 minutes at 20° C. in an aqueous bath containing 1 g per liter of sodium metabisulphite. The bath is then drained and then, without further rinsing, dyeing of the fibre is carried out, 3rd batch (according to the invention): the treatment applied to the second batch is repeated except that 0.2 g per liter of sodium chlorite is added to dye the bath.

Dyeing of each of the batches is carried out as described in Example 1. After dyeing it is noted that the second batch exhibits a colour which is very markedly less intense than the first and third batches, which are both similar.

EXAMPLE 4

The operating method of Example 3 is repeated, except that the dyeing is carried out with the following dyes:

CI Reactive Orange 82

CI Reactive Violet 5

CI Reactive Blue 27

CI Reactive Yellow 37

After dyeing, results which are identical with those of the preceding example are noted with the four dyes employed.

It is self-evident that the embodiments described are merely examples and that they could be modified, especially by substitution of technical equivalents, without departing thereby from the scope of the invention.

I claim:

1. A process for dyeing cellulose fibres selected from the group consisting of cotton, linen and rayon comprising successively the stages of (a) bleaching the cellulose fibres with an alkaline bleaching bath containing aqueous hydrogen peroxide; (b) neutralizing the residual hydrogen peroxide with a reducing agent selected from the group consisting of thiourea, thiosulfate, hydrosulfite and bisulfite; and (c) dyeing, in the presence of an alkaline agent, the cellulose fibres with a dye bath containing a reactive dye sensitive to said reducing agent, in which, after stage (b) and at the latest at the beginning of stage (c), any residual reducing agent is neutralized with an alkali or alkaline-earth metal halogenite.

2. A process according to claim 1, in which the halogenite is an alkali or alkaline-earth metal bromite or chlorite.

3. A process according to claim 2, in which the halogenite is chosen from sodium bromite, potassium bromite, calcium bromite, magnesium bromite, sodium chlorite, potassium chlorite, calcium chlorite and magnesium chlorite.

4. A process according to claim 3, in which the halogenite is sodium chlorite.

5. A process according to claim 4, in which sodium chlorite is added in a quantity ranging from 0.01 to 1 g/liter to the bath containing said residual reducing agent.

6. A process according to claim 5, in which said quantity is between 0.05 and 0.2 g/liter.

7. A process according to claim 1, in which the halogenire is added to the bleaching bath after neutralization of the residual hydrogen peroxide.

8. A process according to claim 1, in which the halogenite is added to a bath of reducing agent for neutralizing the residual hydrogen peroxide.

9. A process according to claim 1, in which the halogenite is added to the dye bath.

10. A process according to claim 1, in which the reactive dye contains the vinyl sulphone group in its molecule.

11. A process according to claim 1, in which the cellulose fibres are cotton fibres.

12. A process according to claim 1, wherein no intermediate rinsing is carried out between stages (a) and (c).

* * * * *